United States Patent [19]

Enoguchi et al.

[11] Patent Number: 4,827,305

[45] Date of Patent: May 2, 1989

[54] DEVELOPING APPARATUS

[75] Inventors: Yuuji Enoguchi; Masashi Yamamoto, both of Higashiosaka; Toshiya Natsuhara, Amagasaki, all of Japan

[73] Assignee: Minolta Camera Kabushiki Kaisha, Osaka, Japan

[21] Appl. No.: 134,507

[22] Filed: Dec. 16, 1987

[30] Foreign Application Priority Data

Dec. 18, 1986 [JP] Japan ..... 61-303276
Feb. 19, 1987 [JP] Japan ..... 62-37373

[51] Int. Cl.[4] ..... G03G 15/06
[52] U.S. Cl. ..... 355/259; 118/661
[58] Field of Search ..... 355/3 DD, 3 R; 118/657, 118/658, 661

[56] References Cited

U.S. PATENT DOCUMENTS 3,953,121 4/1976 Reichart ..... 355/3 DD
3,987,756 10/1976 Katayama et al. ..... 355/4 X
4,426,148 1/1984 Ikemoto et al. ..... 355/3 DD
4,583,832 4/1986 Kasamura et al. ..... 355/3 DD
4,596,455 6/1986 Kohyama et al. ..... 355/3 DD
4,688,923 8/1987 Kohyama ..... 355/3 DD
4,746,951 5/1988 Hayakawa et al. ..... 355/3 DD

FOREIGN PATENT DOCUMENTS 51-74640 of 1976 Japan .
54-51849 of 1979 Japan .
55-62471 of 1980 Japan .
62-45553 of 1987 Japan .

*Primary Examiner*—R. L. Moses
*Attorney, Agent, or Firm*—Burns, Doane, Swecker & Mathis

[57] ABSTRACT

The disclosure relates to a developing apparatus comprising a photosensitive drum, a developing roller and a gap restricting member provided between the photosensitive drum and the developing roller for restricting a minute gap therebetween.

Another embodiment discloses a developing apparatus which comprises a developing roller having an elastic roller and a restricting roller harder than the elastic roller and provided on the same shaft as the elastic roller at each side thereof. The restricting roller has a diameter equal to or smaller than that of the elastic roller when the elastic roller is unloaded.

12 Claims, 6 Drawing Sheets

DEVELOPING APPARATUS

BACKGROUND OF THE INVENTION

1. Field of the Invention

The present invention relates to developing apparatus for use in electrophotographic copying machines or electrostatic copying machines. More particularly, the invention relates to a developing apparatus adapted to hold the surface of its developing roller in contact with the surface of a photosensitive drum under a controlled constant pressure.

2. Description of the Prior Art

With electrophotographic copying machines or electrostatic copying machines, the surface of an image bearing photosensitive drum is uniformly charged first and then exposed to an optical image of an original to form a corresponding electrostatic latent image. Subsequently, the latent image is developed to a visible image with toner supplied to the image bearing drum surface from a developing apparatus. The toner image obtained is thereafter transferred and fixed to paper or like material.

It is very important to restrict the minute gap between the photosensitive drum (electrostatic latent image bearing member) and the developing sleeve in the developing apparatus for use in such electrophotographic copying machines, especially those of the impression type, touchdown type or like contact development type wherein nonmagnetic toner is used as a single-component developer, or those of the noncontact jumping development type.

To obtain satisfactory toner images with the contact developing apparatus wherein the single-component developer consisting only of a toner is brought into contact with the photosensitive drum, with the surface-to-surface distance between the drum and the developing roller set to not greater than the thickness of the toner layer on the roller, it is critical to hold the developing roller in contact with the drum, a toner layer restricting plate or toner scraping-supplying roller under a uniform pressure with good stability. First, the layer of toner supported on the developing roller surface and to be supplied to the drum must have a uniform thickness and be charged to a uniform potential. The pressure to be exerted by the blade for restricting the thickness of the toner layer must therefore be stably controlled to a uniform level over the entire width. Further to maintain constant developing conditions, it is necessary to hold the developing roller in contact with the photosensitive drum under a constant pressure with a contant nip width. To ensure a constant toner scraping-suppying condition, the toner scraping-supplying roller needs to be held in contact with the developing roller under a uniform pressure.

Thus, in the case where single-component or two-component developers are used, it is required to control the gap between the developing roller and the drum to a constant value or to maintain the roller in contact with the drum under a uniform and constant controlled pressure, whereas substantial difficulties have been encountered in controlling the position of the roller relative to the drum as desired.

The gap between the photosensitive drum and the developing roller is conventionally controlled, for example, by the following means. To control the gap to a value exceeding 0.5 mm, the position of the drum and the position of the roller are adjusted by an integral contact restricting member for supporting the bearings members for these drum and roller. The gap is restricted to about 0.5 to about 0.3 mm by a fixed spacer as disclosed in Examined Japanese Patent Application No. SHO 62-45553. U.S. Pat. No. 3,987,756 discloses a roller mounted on the same shaft as the developing roller and having a larger diameater than the developing roller in corresponding relation to the desired gap for use in the magnetic brush developing system employing a two-component developer to provide a controlled gag (400 to 2,000 μm), or for use in the jumping developing system to afford a minute controlled gap (100 to 250 μm).

Nevertheless, the control by these means involves limitations due to the accumulation of machining dimensional errors and encouters extreme difficulties in stably restricting the gap to not greater than 0.1 mm. Moreover, the torsion or the like of the shafts concerned relative to each other also results in an uneven gap. The conventional means are therefore in no way satisfactorily usable for giving a uniformly controlled gap.

Especially for use in the contact developing process wherein a thin layer of toner on the developing roller is brought into contact with the photosensitive drum, none of the conventional developing apparatus are adapted to readily afford a uniform contact pressure between the developing roller and the drum, the toner restricting plate or the scraping roller.

SUMMARY OF THE INVENTION

The main object of the present invention is to provide a developing apparatus comprising a developing roller adapted for surface-to-surface contact with a photosensitive drum under a constant and uniform controlled pressure.

Another object of the invention is to provide a developing apparatus wherein the surface of the developing roller can be held in contact with a toner layer restricting blade, a toner supply roller or the like under a controlled pressure over a controlled width with high stability.

Another object of the invention is to provide a developing apparatus comprising a gap restricting member for ensuring stable contact between the photosensitive drum and the developing roller by automatically correcting the torsion of the shafts of the drum and the roller relative to each other when the drum and the roller are assembled together.

Still another object of the invention is to provide a developing apparatus which is free of the likelihood that the developing roller will deface the photosensitive drum or the like by contact therewith.

These and other objects of the invention can be fulfilled by a developing apparatus which comprises a developing roller for supplying a developer to the surface of an electrostatic latent image bearing member while retaining the developer on the roller surface, and a gap restricting member provided between the developing roller and the image bearing member and comprising a spacer portion, the spacer portion having an arcuate first face approximately conforming to the shape of external surface of the developing roller and an arcuate second face approximately conforming to the shape of external surface of the image bearing member, the first face being positioned on the same curved plane as the surface of the developing roller, the second face being positioned on the same curved plane as the surface of the image bearing member, the center of curvature of the first face and the center of curvature of the second face being positioned on a straight line.

The foregoing and other objects of the invention can be fulfilled further by a developing apparatus which comprises a developing roller for supplying a developer to the surface of an electrostatic latent image bearing member while retaining the developer on the roller surface, the developer roller having an elastic roller, the elastic roller having an elastic surface elastically deformable by contact with the image bearing member, the developing roller having a restricting roller harder than the elastic roller and provided on the same shaft as the elastic roller at each side thereof, the restricting roller having a diameter equal to or smaller than the diameter of the elastic roller when the elastic roller is unloaded.

DETAILED DESCRIPTION OF THE INVENTION

Figure 1:
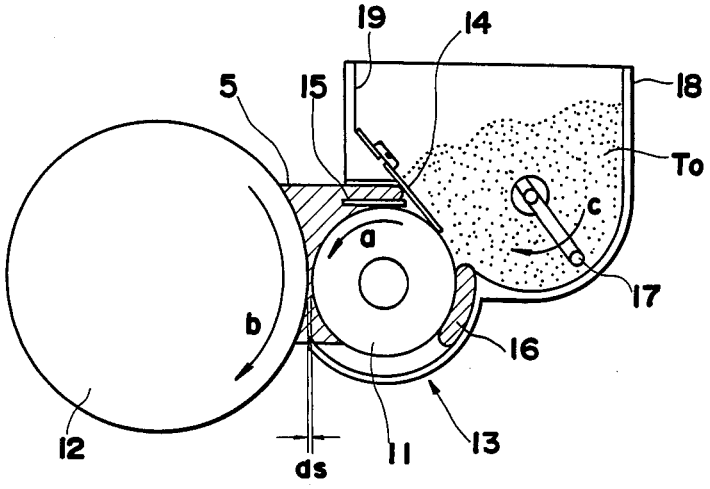
FIG. 1 is a sectional view of a developing apparatus embodying the invention.

FIG. 1 is a sectional view showing a developing apparatus embodying the invention.

With reference to FIG. 1, the developing apparatus 13 comprises a developing roller 11 rotatable in the direction of arrow a shown for supplying a toner to a photosensitive drum 12 rotatable in the direction of arrow b, gap restricting members 5 provided between the developing roller 11 and the drum 12, a restricting blade 14 made for example of a metal or plastic sheet having a thickness of 0.1 to 0.2 mm, fixed to a support plate 19 and pressed against the outer surface of the developing roller 11 for forming a very thin layer of toner, a charge control pad 15 made of a soft elastic rubber material lined with an elastic backup member, a sliding contact member 16 made of expanded polyurethane, soft elastic rubber or polyester sheet or the like for erasing the toner pattern remaining after developing, and a casing 18 supporting or accommodating most of the above components, containing the toner To and equipped with a toner agitator 17 rotatable in the direction of arrow c.

The gap restricting members 5 are provided for restricting a minute gap between the photosensitive drum 12 and the developing roller 11. The developing roller 11 is positioned adjacent or to held in contact with the drum 12 by the gap restricting members 5.

Figure 2:
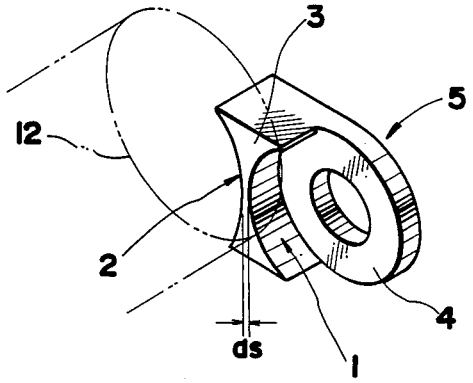
FIG. 2 is a perspective view showing an embodiment of gap restricting member included in the developing apparatus of the invention.

FIG. 2 is a perspective view showing an embodiment of restricting member 5.

The gap restricting member 5 of the invention comprises a spacer portion 3 having an arcuate first face 1 adapted for contact with the developing roller 11 and an arcuate second face 2 for contact with the drum 12, and a support portion 4 for attaching the spacer portion 3 to the drum 12 or the developing roller 11.

The first face 1 is in the form of a curved arcuate surface having substantially the same curvature as the developing roller surface. The second face 2 is in the form of a curved arcuate surface having substantially the same curvature as the drum surface.

The first face 1 is adapted for contact with the developing roller surface, and the second face 2 for contact with the surface of the drum 12 serving as an electrostatic latent image bearing member. The center of curvature of the first face 1 and the center of curvature of the second face 2 are positioned on a straight line.

The support portion 4 is integral with the spacer portion 3 and is mounted on the rotary shaft of the developing roller or the drum.

It is desired that the gap restricting member be made of a synthetic resin such as polyethylene, nylon, polyacetal or polypropylene. Preferably, the member is molded integrally of such a material.

Figure 3:
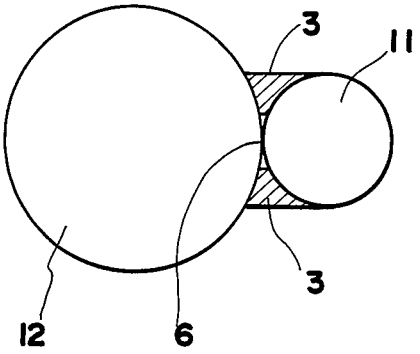
FIGS. 3 to 5 are sectional views schematically showing other embodiments of gap restricting members.
Figure 4:
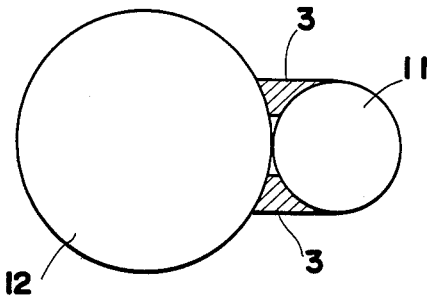

The arcuate form of the first and second faces is substantially a circular arc and may be partially discrete or divided insofar as these faces can be in contact with the developing roller and the drum, respectively, substantially in an arcuate form. For example, the spacer portion 3 shown in FIG. 3 comprises divided segments, so that each of the first and second faces comprises separate portions. The divided segments are interconnected by a spacer film 6 of polyester, Teflon or the like having a small coefficient of friction on the drum 12 and the developing roller 11. The surface-to-surface distance ds between the developing roller and the drum can be restricted to the small range of $0.1\ \text{mm} \geqq ds > 0\ \text{mm}$ more conveniently by this restricting member than the restricting member of FIG. 2. Further as shown in FIG. 4, the spacer portion 3 may comprise divided segments with a space formed therebetween to form each of the first and second faces by completely separate two portions. This restricting member is suitable for restricting the position of the developing roller and the drum as held in contact with each other ($ds \leqq 0$).

Figure 5:
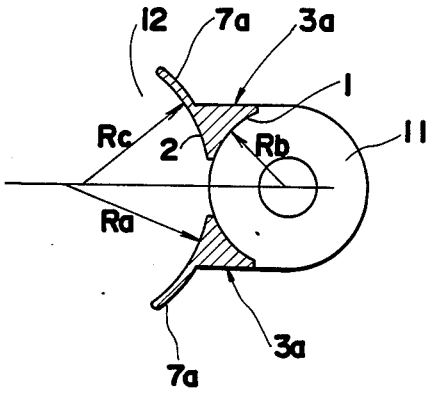

FIG. 5 shows a modification of the first embodiment of the invention. The illustrated gap restricting member comprises a restricting portion **3*a* for restricting the gap between the drum 12 and the developing roller 11, and elastic contact portions 7*a* projecting from the respective ends of the second face 2 of the restricting portion 3*a*. When the restricting member is unloaded with its second face 2 out of contact with the drum 12, the elastic contact portions 7*a* have a radius of curvature Rc which is smaller than the radius of curvature Ra of the restricting portion 3*a*. When the restricting member is installed in place, the elastic portions 7*a* are elastically deformed by contact with the surface of the drum 12** to fit to the drum surface. Accordingly, the restricting member, when installed, automatically corrects the torsion or displacement of the shaft of the developing roller relative to the drum, precluding the backlash that could result from the limitation of machining accuracy and assuring the adjustment of the contact and the gap with greatly improved precision. Further in converse relation to the construction shown in FIG. 5, the elastic contact portions may be provided as projected from the opposite ends of the first face.

The gap restricting member of the present invention may be molded integrally with, and as a portion of, a common side plate component of the unit including the drum, developing roller, cleaner, etc.

According to the present embodiment, the first and second faces of the gap restricting member are adapted to contact the developing roller surface and the drum surface, respectively, or to contact a position restricting member which, for example, is mounted on the same shaft as the developing roller or the drum at each side thereof for restricting the position of the roller or the drum. It is critical that the first face be positioned on the same curved plane as the surface of the developing roller and that the second face be positioned on the same curved plane as the surface of the drum.

Figure 6:
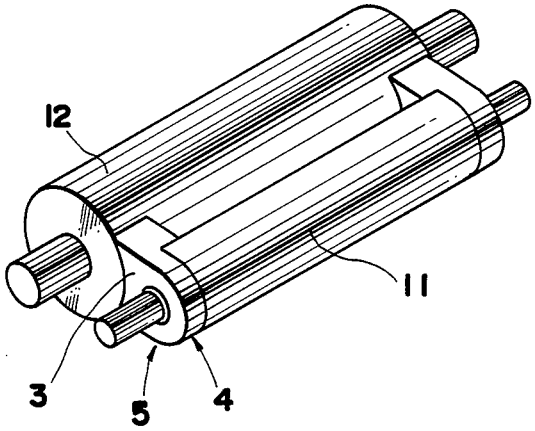
FIG. 6 is a perspective view showing the gap restricting member of FIG. 2 as attached to each end of a developing roller.

The developing apparatus of the invention having the gap restricting member operates as follows. FIG. 6 is a perspective view showing the gap restricting member of FIG. 2 attached to each end of the developing roller 11. With reference to FIG. 6, the gap restricting member 5 is mounted on the shaft of the developing roller 11 at each end thereof by the support portion 4. The spacer portion 3 is interposed between the roller 11 and the drum 12.

As seen in FIGS. 1 and 2, the developing roller 11 and the photosensitive drum 12 are pressed toward the gap restricting member 5 relative to each other. The developing roller 11 rotates in the direction of arrow a in intimate contact with the first face 1 of the gap restricting member 5, while the drum 12 rotates in the direction of arrow b in intimate contact with the second face 2. Accordingly, the distance between the roller 11 and the drum 12 is properly and stably controlled to the gap ds set by the gap restricting member 5. For this reason, the minute gap can be controlled with very high stability by assuring accuracy in preparing the gap restricting member 5 and in preparing the drum and developing roll surfaces, free of the conventional problem, i.e, without the accumulation of dimensional errors involved in machining the drum and developing roller shaft bearings, the gap restricting roller, etc. Whereas contact developing with a single-component developer requires a gap (0.1 to 0 mm) which is extremely smaller than the gap (ds=0.7 to 0.5 mm) for systems with two-component developers or the gap (about 0.3 mm ds) for jumping developing systems with single-component developers, such a small gap can be obtained with high stability.

The gap restricting member provided between the developing roller of the present developing apparatus and the photosensitive drum makes it possible to readily control the gap therebetween to a very small value and also to automatically easily correct the torsion of the roller and drum shafts relative to each other when these components are assembled. In fact, the gap can be restricted to a very small value of up to 0.1 mm or to zero for controlled contact with high stability.

Consequently, the gap can be restricted with sufficiently high precision even in single-component developer systems wherein a very thin layer of charged toner is formed on the developing roller and is supplied to an electrostatic latent image formed on the drum for contact development.

A contact development test was conducted using the developing apparatus of the invention comprising a developing roller of electrically conductive elastic rubber material (hardness 40 degrees) and a gap restricting member provided between the roller and a photosensitive drum. The developing roller was driven at three times the speed of the drum and held in contact therewith at a pressure of 0.4 g/mm and with a nip width of 1.5 mm. Consequently, very satisfactory developed images were obtained free of any defect. The contact pressure and the nip width were maintained with good stability for a prolonged period of time.

Figure 7:
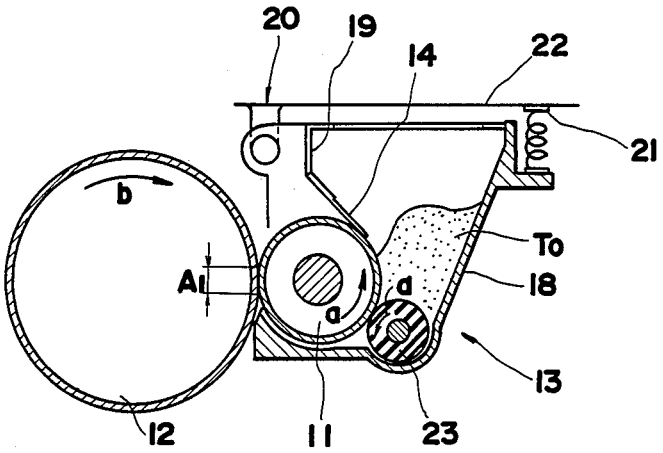
FIG. 7 is a sectional view showing another developing apparatus i.e., a second embodiment of the invention.

Next, a second embodiment of the invention will be described. The second embodiment is a contact developing apparatus having a developing roller in contact with a photosensitive drum, the gap between the roller and the drum being not greater than the thickness of toner layer on the roller. FIG. 7 is a sectional view showing the second embodiment. This embodiment is similar to the one shown in FIG. 1 in construction, so that throughout FIGS. 1 and 7, like parts are designated by like reference numerals. The different features only will be described. With the developing apparatus of FIG. 7, a toner supply roller 23 is provided in contact with the developing roller 11. The casing 18 is supported at its one end by a support member 20 on a main body 22 and at the other end by a fixing spring 21 on the body and is pivotally movable as supported by the member 20 relative to the drum 12. As will be described later, the developing roller 11 of the second embodiment has an elastic roller having an elastic surface, and restricting rollers harder than the elastic roller and mounted on the same shaft as the elastic roller at the outer ends of this roller.

Further according to this embodiment, the developing roller 11 is provided in contact with the photosensitive drum 12, so that the surface of the elastic roller 24 of the developing roller 11 is elastically deformed by contact with the drum 12.

Figure 8:
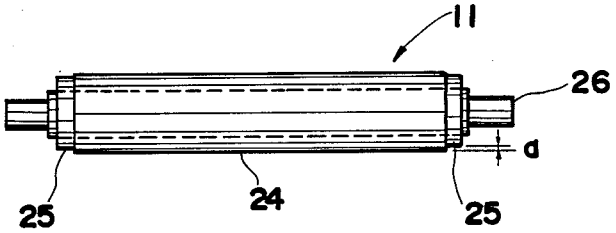
FIG. 8 is a front view showing a developing roller included in the second embodiment.

More specifically stated with reference to the front view of FIG. 8 showing the developing roller 11, the roller 11 comprises an elastic roller 24 having on its surface at thin metal film providing an electrically conductive electrode surface, a rotary shaft 26 supporting the elastic roller 24 thereon, and restricting rollers 25 mounted on the respective ends of the shaft 26 and having a diameter slightly smaller than that of the elastic roller 24 (by 2*d*) when the roller 24 is unloaded. The elastic roller 24 comprises an inner elastic layer of expanded polyurethane or silicone or like elastic rubber, and a thin nickel, aluminum or like film rough-surfaced (1 to 10 $\mu$Rz) as by blasting. The restricting rollers 25 are made of a plastic material such as nylon, polyethylene, polyacetal or phenolic resin and are harder than the elastic roller 24. When the developing roller 11 is brought into contact with the drum 12, the surface of the elastic roller 24 is elastically deformed, and the developing roller 11 is set in such a position relative to the drum that the restricting rollers 25 bear on the drum 12.

The supply roller 23 is in the form of an elastic roller of expanded silicone rubber or polyurethane foam, is pressed by a predetermined pressure (amount of deformation, 1 to 0.5 mm) into contact with the developing roller 11 rotating in the direction of arrow a in FIG. 7 and supplies a nonmagnetic toner To onto the developing roller 11 while rotating in a direction opposite to the direction of arrow a at the contact portion (i.e. the direction of arrow d shown). The speed of rotation of the supply roller 23 is determined according to the amount of toner required.

A restricting blade 14 is fixed to a support plate 19 attached to the casing 18, is resilient and has a forward end in pressing contact with the peripheral surface of the developing roller 11. The suitable material for the restricting plate is any of those heretofore used for blades for restricting the thickness of toner layer, such as magnetic materials, stainless steel or like nonmagnetic materials and plastic materials. Especially suitable are resilient plates such as thin pieces of ribbon steel or SUS spring steel, and thin metal plates having a plastic sheet or film affixed thereto.

Preferably, the material of the blade surface is one included in the triboelectric series of a polarity opposite to the polarity of the charge on the toner and in a remote position therefrom. For example, a coating of fluorocarbon resin is desirable for use with positively charged toners, or a nylon coating for negatively charged toners.

While nonmagnetic toners of the single-component developer type are suitably usable for the present embodiment, magnetic toners are also usable therefor.

Figure 9:
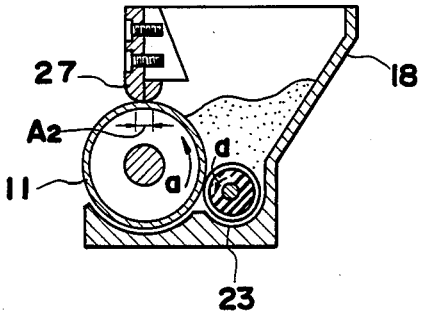
FIG. 9 is a sectional view showing another embodiment of developing apparatus of the invention.

FIG. 9 is a sectional view schematically showing another developing apparatus embodying the invention. With this embodiment, a toner layer restricting member 27 having no resiliency and circular arc in cross section is fixed to the casing 18 and is in pressing contact, over a nip width A2, with the elastic surface of a developing roller 11 having elasticity.

The developing roller 11 may be provided with the aforementioned restricting rollers 25 so that not only the drum but also the toner scraping-supplying roller or the fixed toner layer restricting blade will be pressed against the developing roller 11 under an individually controlled pressure.

Figure 10:
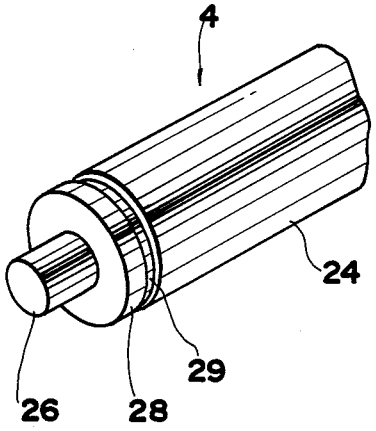
FIG. 10 is a perspective view showing another embodiment of developing roller.
Figure 11:
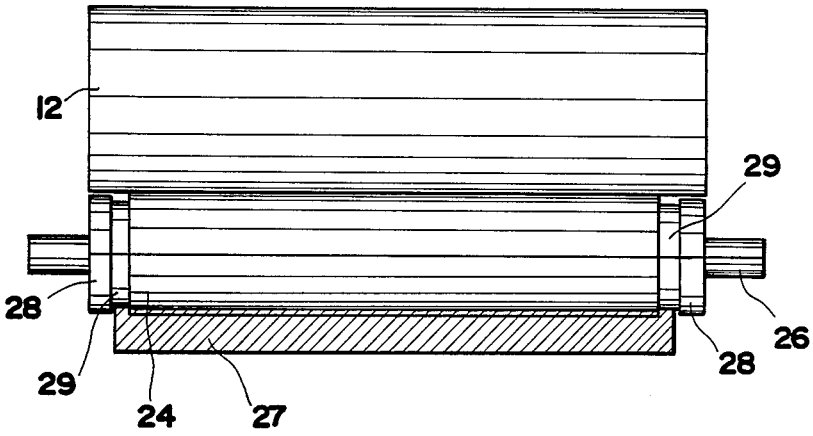
FIG. 11 is a plan view showing an arrangement including the developing roller of FIG. 10.
Figure 12:
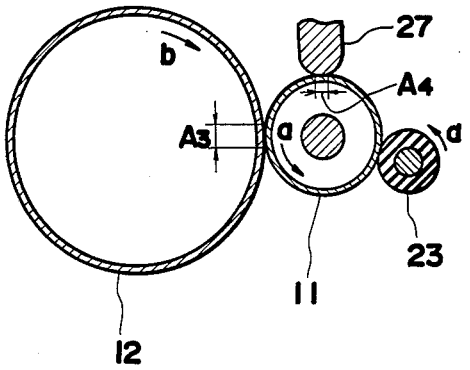
FIG. 12 is a schematic sectional view of FIG. 11.

FIG. 10 is a perspective view partly broken away and showing another developing roller embodying the invention. With reference to FIG. 10, the developing roller 11 comprises an elastic roller 24, first restricting rollers 28 provided on the respective outer sides of the elastic roller 24 and having a slightly smaller diameter than the roller 24, and second restricting rollers 29 having a smaller diameter than the first restricting rollers 28 and interposed between the elastic roller 24 and the first restricting roller 28. The restricting rollers 28, 29 are rotatably provided at the opposite ends of the developing roller 11. The lengthwise opposite ends of a restricting blade 27 are in contact with the second restricting roller 29, whereby the pressure of the blade on the roller 11 is adjustable (see FIG. 11). More specifically, the photosensitive drum is positioned with its surface in contact with the first restricting rollers 28, while the restricting blade 27 is so positioned that its opposite ends bear on the second restricting rollers 29. As seen in FIG. 12, this makes it possible for the drum 12 and the blade 27 to contact the developing roller 11 under different controlled pressure with different nip widths A3, A4, respectively.

The second restricting roller of the smaller diameter may be disposed outside the first roller. The restricting rollers may be of the same diameter as the elastic roller. Furthermore, three or more restricting rollers may be provided at each end of the developing roller.

The apparatus of the invention shown in FIG. 7 operates in the following manner for developing a latent image on the photosensitive drum 12.

The toner To contained in the casing 18 is supplied onto the periphery of the developing roller 11 by the supply roller 23 which is in rotation in the direction of arrow d shown. The developing roller 11 receives the toner supply while rotating in the direction of arrow a shown in contact with the supply roller 23. The toner on the developing roller 11 comes into contact with the restricting blade 14 with the rotation of the roller 11 and has the thickness of its layer thereby restricted (to about 30 μm) and, at the same time, is charged owing to the friction between the blade 14 and the developing roller 11 according to the triboelectric series of the materials concerned. With the rotation of the developing roller, the toner thus uniformly charged and restricted in the thickness of its layer further travels to the developing position where the developing roller is elastically deformed with the nip width A1. At this position, the toner moves in conformity with the pattern of the electrostatic latent image on the drum 12.

According to the second embodiment of the invention described above, the restricting blade, the toner supply roller or like member can be held in contact with the developing roller under a controlled pressure with a controlled nip width with high stability. Consequently, the apparatus can be assembled with greater ease, with its components set in position relative to one another with improved precision, to produce developed images of higher quality. The invention further obviates the likelihood that the developing roller will deface the photosensitive drum, etc. by contact therewith.

What is claimed is:

1. A developing apparatus comprising;

a developing roller for supplying a developer to the surface of an electrostatic latent image bearing member while retaining the developer on the roller surface; and a gap restricting member provided between the developing roller and the image bearing member and comprising a spacer portion, the spacer portion having an arcuate first face approximately conforming to the shape of external surface of the developing roller and an arcuate second face approximately conforming to the shape of external surface of the image bearing member, the first face being so positioned to approximately coincide with the same curved plane as the surface of the developing roller, the arcuate first face being in contact with the surface of the developing roller, the second face being so positioned to approximately coincide with the same curved plane as the surface of the image bearing member, the second face being in contact with the surface of the image bearing member, the center of curvature of the first face and the center of curvature of the second face being positioned on a straight line.

2. A developing apparatus comprising;

a developing roller for supplying a developer to the surface of an electrostatic latent image bearing member while retaining the developer on the roller surface; and a gap restricting member provided between the developing roller and the image bearing member and comprising a spacer portion, the spacer portion having an arcuate first face approximately conforming to the shape of external surface of the developing roller and an arcuate second face approximately conforming to the shape of external surface of the image bearing member, the first face being so positioned to approximately coincide with the same curved plane as the surface of the developing roller, said first face and said second face being integral with each other, the second face being so positioned to approximately coincide with the same curved plane as the surface of the image bearing member, the center of curvature of the first face and the center of curvature of the second face being positioned on a straight line.

3. A developing apparatus comprising:

a developing roller for supplying a developer to the surface of an electrostatic latent image bearing member while retaining the developer on the roller surface; and a gap restricting member provided between the developing roller and the image bearing member and comprising a spacer portion, the spacer portion having an arcuate first face approximately conforming to the shape of external surface of the developing roller and an arcuate second face approximately conforming to the shape of external surface of the image bearing member, the first face and second face being provided opposed to each other, the first face being separated into two portions so as to be positioned to approximately coincide with the same curved plane as the surface of the developing roller, the second face being separated into two portions so as to be positioned to approximately coincide with the same curved plane as the surface of the image bearing member, the center of curvature of the first face and the center of curvature of the second face being positioned on a straight line.

4. A developing apparatus as claimed in claim 3 wherein the arcuate first face is in contact with the surface of the developing roller and the second face in contact with the surface of the image bearing member.

5. A developing apparatus as claimed in claim 3 wherein a film member is provided between the first face and the second face, the electrostatic latent image bearing member being held in contact with the developing roller through the film member.

6. A developing apparatus comprising:

a developing roller for supplying a developer to the surface of an electrostatic latent image bearing member while retaining the developer on the roller surface; and a gap restricting member provided between the developing roller and the image bearing member and comprising a spacer portion and a support member formed integral with the spacer portion, the spacer portion having an arcuate first face approximately conforming to the shape of external surface of the developing roller and an arcuate second face approximately conforming to the shape of external surface of the image bearing member, said first face and said second face being integral with each other the first face being so positioned to approximately coincide with the same curved plane as the surface of the developing roller, the second face being so positioned to approximately coincide with the same curved plane as the surface of the image bearing member, the center of curvature of the first face and the center of curvature of the second face being positioned on a straight line.

7. A developing apparatus comprising:

a developing roller for supplying a developer to the surface of an electrostatic latent image bearing member while retaining the developer on the roller surface; and a gap restricting member provided between the developing roller and the image bearing member and comprising a spacer portion, the spacer portion having an arcuate first face approximately conforming to the shape of external surface of the developing roller and an arcuate second face approximately conforming to the shape of external surface of the image bearing member, the first face being held in contact with the surface of the developing roller, the second face being held in contact with the surface of the image bearing member, the spacer portion having elastic members projecting from each end of the first and/or second face, each elastic members having a radius of curvature which is smaller than the radius of curvature of the first face and/or second face when the first face and/or second face and elastic members are all unloaded, the center of curvature of the first face and the center of curvature of the second face being positioned on a straight line.

8. A developing apparatus comprising:

a developing roller parallelly provided to an electrostatic latent image bearing member for supplying a developer to the surface of the electrostatic latent image bearing member while retaining the developer on the roller surface, the developing roller having an elastic roller and a restricting roller harder than the elastic roller and provided on the same shaft as the elastic roller at each side thereof, the elastic roller having an elastic surface elastically deformable by contact with the image bearing member, the restricting roller having a diameter equal to or smaller than the diameter of the elastic roller when the elastic roller is unloaded.

9. A developing apparatus as claimed in claim 8 further comprises a developer restricting blade with no elasticity, said developer restricting blade restricting the thickness of the developer formed on the developing roller by contact with the elastic roller of the developing roller, the elastic roller being deformed by pressing contact with the blade.

10. A developing apparatus comprising:

a developing roller parallelly provided to an electrostatic latent image bearing member for supplying a developer to the surface of the electrostatic latent image bearing member while retaining the developer on the roller surface, the developing roller having an elastic roller, a first restricting portion harder than the elastic roller and provided on the same shaft as the elastic roller at each side thereof and a second restricting portion harder than the elastic roller and provided between the first restricting portion and the elastic roller, the elastic roller having an elastic surface elastically deformable by contact with the image bearing member, the first restricting portion having a diameter equal to or smaller than the diameter of the elastic roller when the elastic roller is unloaded, the second restricting portion having a diameter smaller than the diameter of the first restricted portion.

11. A developing apparatus as claimed in claim 10 further comprises a developer restricting blade with no elasticity, said developer restricting blade entirely covering the elastic roller and restricting the thickness of the developer formed on the developing roller by contact with the elastic roller of the developing roller, the elastic roller being deformed by pressing contact with the blade.

12. A developing apparatus as claimed in claim 11 wherein said developer restricting blade is in contact with at least the second restricting portion.

* * * * *